US008226429B2

(12) United States Patent
Umetsu et al.

(10) Patent No.: US 8,226,429 B2
(45) Date of Patent: Jul. 24, 2012

(54) CONNECTION STRUCTURE

(75) Inventors: Jun Umetsu, Hitachi (JP); Hideaki Takehara, Hitachi (JP); Kunihiro Fukuda, Tsukuba (JP); Sachio Suzuki, Hitachi (JP); Yuta Kataoka, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 164 days.

(21) Appl. No.: 12/857,934

(22) Filed: Aug. 17, 2010

(65) Prior Publication Data

US 2011/0159717 A1 Jun. 30, 2011

(30) Foreign Application Priority Data

Dec. 24, 2009 (JP) ..... 2009-293097

(51) Int. Cl.
*H01R 13/15* (2006.01)

(52) U.S. Cl. ..... 439/262

(58) Field of Classification Search ..... 439/261–263
See application file for complete search history.

(56) References Cited

U.S. PATENT DOCUMENTS

| | | | | |
|---|---|---|---|---|
| 1,917,009 | A * | 7/1933 | Betts et al. | 439/262 |
| 7,291,030 | B2 * | 11/2007 | Mohs | 439/263 |
| 2009/0075506 | A1 | 3/2009 | Suzuki | |

FOREIGN PATENT DOCUMENTS

| | | |
|---|---|---|
| JP | A-2004-056924 | 2/2004 |
| JP | B2-4037199 | 11/2007 |
| JP | A-2009-70754 | 4/2009 |

* cited by examiner

*Primary Examiner* — Phuong Dinh
(74) *Attorney, Agent, or Firm* — Scully, Scott, Murphy & Presser, PC

(57) ABSTRACT

A connection structure includes a first terminal housing with a plurality of first connecting terminals aligned and accommodated therein, a second terminal housing with a plurality of second connecting terminals aligned and accommodated therein, a plurality of insulation members aligned and accommodated in the first terminal housing, two connecting members disposed to sandwich a stack structure of the plurality of the first connecting terminals, the plurality of the second connecting terminals and the plurality of the insulation members at a top end and a bottom end of the stack structure, and a synchronizing member to allow the two connecting members to press synchronously the adjacent insulation member.

5 Claims, 6 Drawing Sheets

5 FIRST TERMINAL HOUSING
7 SECOND TERMINAL HOUSING
9 CONNECTING MEMBER
40 AVOIDANCE GROOVE
47 SYNCHRONIZING MEMBER

4a–4c FIRST CONNECTING TERMINAL
5 FIRST TERMINAL HOUSING
6a–6c SECOND CONNECTING TERMINAL
7 SECOND TERMINAL HOUSING
8a–8d INSULATION MEMBER
9 CONNECTING MEMBER
47 SYNCHRONIZING MEMBER

9 CONNECTING MEMBER
9a LARGE DIAMETER PART
9b SMALL DIAMETER PART
14 PACKING

CONNECTION STRUCTURE

The present application is based on Japanese patent application No. 2009-293097 filed on Dec. 24, 2009, the entire contents of which are incorporated herein by reference.

BACKGROUND OF THE INVENTION

1. Field of the Invention

This invention relates to a connection structure, for use in eco-friendly cars, such as hybrid vehicles, electric vehicles and the like, and in particular, for being capable of use for a portion to connect a power harness, which is used for large power transmission.

2. Description of the Related Art

In hybrid vehicles, electric vehicles and the like which have remarkably developed in recent years, a power harness, which is used for large power transmission for connection between devices, has at its one end a connector, which consists of two separate portions: a male connector portion with a male terminal and a first terminal housing accommodating that male terminal, and a female connector portion with a female terminal connected with the male terminal and a second terminal housing accommodating that female terminal (See, e.g., JP-A-2009-70754)

In recent years, such eco-friendly cars have been designed to reduce the weights of all parts thereof, to enhance the energy saving performance of the cars. As one effective means to reduce the weights of parts of the cars, it has been proposed to reduce the sizes of the parts.

For example, a technique as described below, which has been disclosed by JP-B-4037199, is known in the art.

JP-B-4037199 discloses an electrical connection structure for a vehicle, which is for connecting multiphase connecting terminals of a conductive member drawn out from a motor for driving the vehicle, and multiphase connecting terminals of a power line cable drawn out from an inverter for driving the motor. The technique used in the electrical connection structure disclosed by JP-B-4037199 is as follows: Each phase connecting terminal of the conductive member and each corresponding phase connecting terminal of the power line cable are overlapped, and isolating members are disposed on opposite surfaces to the overlapped surfaces of the connecting terminals, respectively, and these overlapped connecting terminals and isolating members are collectively fastened in an overlapping direction with a single bolt provided in a position to penetrate these overlapped connecting terminals and isolating members.

In other words, in the technique used in the electrical connection structure disclosed by JP-B-4037199, the single bolt is tightened in the overlapping direction (or stacking direction), to collectively hold the multiplicity of contacts between the connecting terminals, which are the overlapped surfaces of the connecting terminals, and thereby fix the connecting terminals at the contacts therebetween, for electrical connections between the connecting terminals, respectively. The construction disclosed by JP-B-4037199 is effective in easily ensuring size reduction, compared to a technique disclosed by JP-A-2009-070754.

SUMMARY OF THE INVENTION

However, in the case of the connection structure of JP-B-4037199, since the pressing force of the bolt (or the connecting member) is applied only in one direction, displacement of the connecting terminal may increase thereby. Therefore, a problem may arise that the connecting terminal deforms when the pressing force of the connecting member is released.

It is an object of the invention to provide a connection structure that includes plural first connecting terminals, plural second connecting terminals and plural insulation member (or insulation plates) arranged in a stacked state, and that can prevent the first connecting terminals and the second connecting terminals from being deformed.

(1) According to one embodiment of the invention, a connection structure comprises:

a first terminal housing with a plurality of first connecting terminals aligned and accommodated therein;

a second terminal housing with a plurality of second connecting terminals aligned and accommodated therein;

a plurality of insulation members aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of insulation members;

two connecting members disposed to sandwich a stack structure of the plurality of the first connecting terminals, the plurality of the second connecting terminals and the plurality of the insulation members at a top end and a bottom end of the stack structure, the two connecting members each pressing an adjacent insulation member of the plurality of insulation members, to thereby collectively fix the plurality of first connecting terminals and the plurality of second connecting terminals at contacts for electrical connections therebetween; and a synchronizing member to allow the two connecting members to press synchronously the adjacent insulation member.

In the above embodiment (1) of the invention, the following modifications and changes can be made.

(i) The synchronizing member comprises a lever to rotate around the two connecting members as a rotation shaft, the two connecting members are each screwed into the first terminal housing or the second terminal housing to press the adjacent insulation member, and when the lever rotates to screw the two connecting members thereinto, the two connecting members is allowed to press synchronously the adjacent insulation member.

(ii) The connecting member comprises a large diameter part and a small diameter part integrated with the large diameter part and screwed into the first terminal housing or the second terminal housing, and the large diameter part comprises a packing for sealing between the connecting member and the first terminal housing or the second terminal housing.

(iii) The first terminal housing or the second terminal housing into which the connecting members are not screwed comprises an avoidance groove for avoiding the lever.

(iv) One of the plurality of first connecting terminals that is centrally located when the stacked state is exhibited is more rigid than an other of the plurality of first connecting terminals.

Points of the Invention

According to one embodiment of the invention, a connection structure is constructed such that a stack structure of plural first connecting terminals, plural second connecting terminals and plural insulation members is synchronously pressed while being sandwiched from two directions by two connecting members. Therefore, displacement of the first connecting terminals and the second connecting terminals when pressed by the connecting members can be reduced to half as compared to the conventional structure with only one connecting member installed therein so as to suppress deformation thereof.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
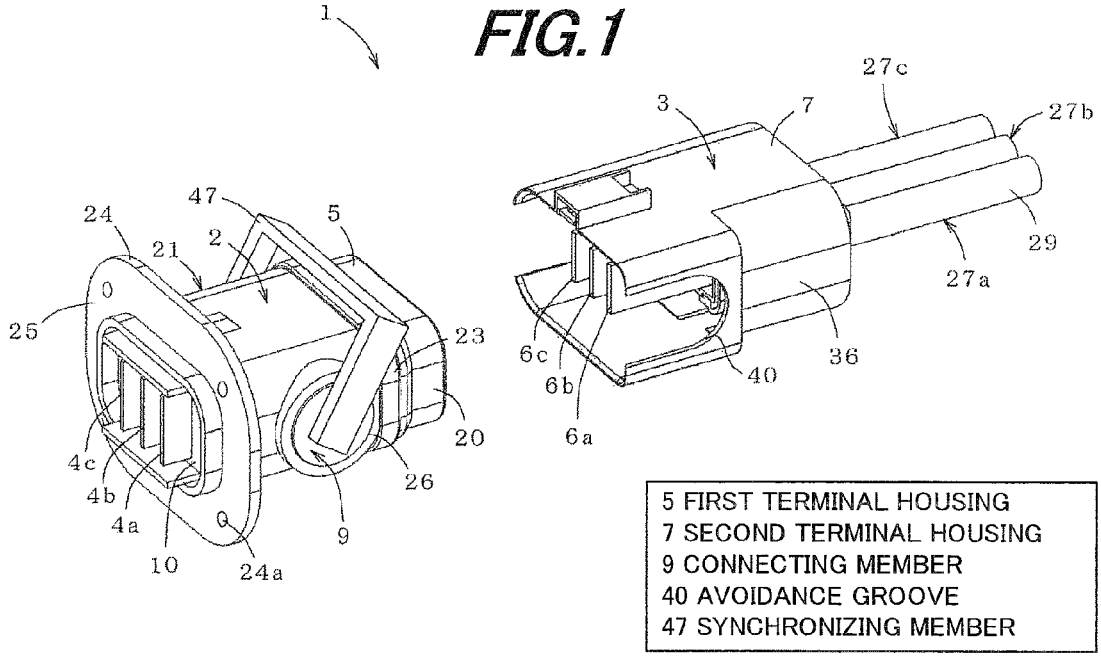
FIG. 1 is a perspective view schematically showing a first connector part and a second connector part that constitute a connector according to one embodiment of the invention.

The preferred embodiments according to the invention will be explained below referring to the drawings.

Here, a connector will be explained as an example of the connection structure according to the invention.

Figure 2:
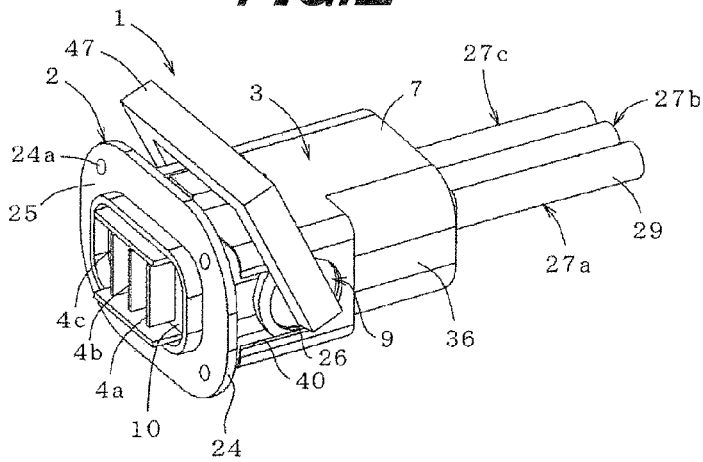
FIG. 2 is a perspective view schematically showing the connector after the first connector part and the second connector part are fitted to each other.
Figure 3:
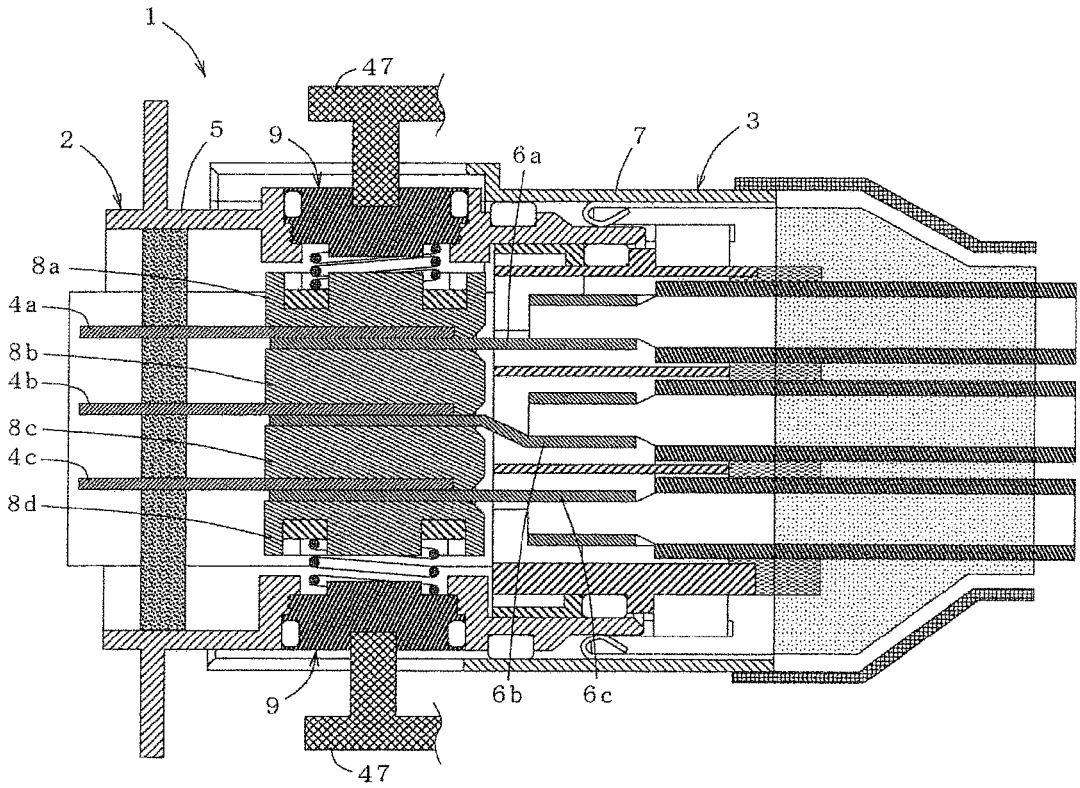
FIG. 3 is a cross-sectional view schematically showing the connector after the first connector part and the second connector part are fitted to each other.

FIG. 1 is a perspective view schematically showing a first connector part and a second connector part that constitute a connector according to one embodiment of the invention, FIG. 2 is a perspective view schematically showing the connector after the first connector part and the second connector part are fitted to each other and FIG. 3 is a cross-sectional view schematically showing the connector after the first connector part and the second connector part are fitted to each other.

As shown in FIGS. 1 to 3, the connector 1 according to the embodiment includes a first connector part 2 and a second connector part 3 and is used for collectively connecting a plurality of power-supply lines by allowing the connector parts 2, 3 to be fitted to each other.

Particularly, the connector 1 includes the first connector part 2 having a first terminal housing 5 in which a plurality of (three) first connecting terminals (male terminals) 4*a* to 4*c* are housed in alignment with each other, the second connector part 3 having a second terminal housing 7 in which a plurality of (three) second connecting terminals (female terminals) 6*a* to 6*c* are housed in alignment with each other and a plurality of insulation members (insulation plates) 8*a* to 8*d* housed in the first terminal housing 5 in alignment with each other, installed so as to sandwich each of the plurality of the first connecting terminals 4*a* to 4*c*, and used for insulating among the first connecting terminals 4*a* to 4*c*, and the connector 1 has a structure that when the first terminal housing 5 of the first connector part 2 and the second terminal housing 7 of the second connector part 3 are fitted to each other, each one surface of the plurality of the first connecting terminals 4*a* to 4*c* and each one surface of the plurality of the second connecting terminals 6*a* to 6*c* face each other so that they form a pair with each other (each pair of the first connecting terminal 4*a* and the second connecting terminal 6*a*, the first connecting terminal 4*b* and the second connecting terminal 6*b*, and the first connecting terminal 4*c* and the second connecting terminal 6*c*), and each of the plurality of the insulation members 8*a* to 8*d* is arranged so as to sandwich each of the plurality of the connecting terminal pairs including the plurality of the first connecting terminals 4*a* to 4*c* and the plurality of the second connecting terminals 6*a* to 6*c* that face each other, so that a stacked state is formed.

The connector 1 is used for, for example, connection between a vehicle drive motor and an inverter which drives the motor.

More particularly, the first terminal housing 5 (FIG. 1 shows as a part located in a left side) of the first connector part 2 is fitted to a shield case of the motor, and a portion of the first connecting terminals 4*a* to 4*c* exposed from the first terminal housing 5 is connected to each terminal in a terminal block installed in the shield case of the motor. The second connector part 3 that electrically connects to the inverter is fitted to the first connector part 2, so that the motor and the inverter are connected to each other. In the above, a case of connection in the motor side has been explained, but a case of connection in the inverter side is similar to the case of the motor side.

Hereinafter, each composition of the first connector part 2 and the second connector part 3 will be explained in detail.

Figure 4:
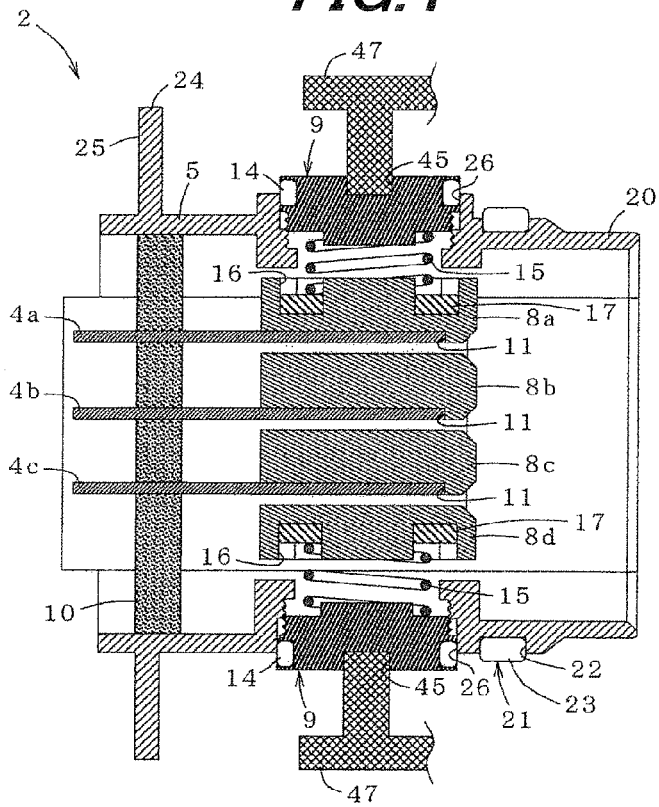
FIG. 4 is a cross-sectional view schematically showing the first connector part.

As shown in FIG. 4, the first connector part 2 internally holds three first connecting terminals 4*a* to 4*c* located apart at certain intervals in alignment with each other, and has the first terminal housing 5 in which three first connecting terminals 4*a* to 4*c* are housed in alignment with each other, a plurality of insulation members 8*a* to 8*d* having a nearly rectangular parallelepiped shape housed in the first terminal housing 5 in alignment with each other, and two connecting members 9 disposed so as to sandwich the plurality of the first connecting terminals 4*a* to 4*c*, the plurality of the second connecting terminals 6*a* to 6*c* and the plurality of the insulation members 8*a* to 8*d* that are arranged so as to form the stacked state from the upper and lower sides in the direction of stack.

Further, the first terminal housing 5 can be any one of a male type one (a male side terminal housing) and a female type one (a female side terminal housing) as a terminal housing. Here, as an example, a case that the first terminal housing 5 is a male side terminal housing will be explained.

The first connecting terminals 4*a* to 4*c* are respectively a plate-like terminal, are formed of a nonconductive resin such as polyphenylene sulfide (PPS) resin, polyphthalamide (PPA)

resin, polyamide (PA) resin, polybutylene terephthalate (PBT) resin, epoxy based resin, and are held in a resin compact 10 that is a part of the first terminal housing 5 so as to be located apart at certain intervals in alignment with each other. A method of allowing the resin compact 10 to hold the first connecting terminals 4*a* to 4*c* includes, for example, a method of inserting the first connecting terminals 4*a* to 4*c* into the resin at the time of molding the resin compact 10 and then hardening the resin so as to allow the resin compact 10 to hold the first connecting terminals 4*a* to 4*c* and a method of pressing the first connecting terminals 4*a* to 4*c* into the resin compact 10 that is preliminarily molded so as to allow the resin compact 10 to hold the first connecting terminals 4*a* to 4*c*.

In addition, each of the first connecting terminals 4*a* to 4*c* is integrally fixed to the insulation members 8*a* to 8*c* that is arranged in the other surface (a surface opposite to the surface to be bonded to the second connecting terminals 6*a* to 6*c*) side adjacently. Namely, as mentioned above, the resin compact 10 holds the first connecting terminals 4*a* to 4*c* so as to be located apart at certain intervals in alignment with each other, but the insulation members 8*a* to 8*c* are integrally fixed to forward end side of the respective first connecting terminals 4*a* to 4*c*, so that as a result, the insulation members 8*a* to 8*c* are also located apart at certain intervals in alignment with each other. Due to this composition, insulation properties among each contacts and insertion properties of the second connecting terminals 6*a* to 6*c* at the fitting can be ensured.

Electricity of different voltage and/or different current transmits to each of the first connecting terminals 4*a* to 4*c*. For example, in the embodiment, a power line of three-phase alternating current used for a connection between a motor and an inverter is assumed, and an alternating current having different phases by 120 degrees is transmitted to each of the first connecting terminals 4*a* to 4*c*. For the purpose of transmission loss reduction at the connector 1 and the like, it is preferable that each of the first connecting terminals 4*a* to 4*c* is formed of metal having high electric conductivity such as silver, copper, aluminum. In addition, each of the first connecting terminals 4*a* to 4*c* has a certain degree of flexibility.

Further, one first connecting terminal 4*b* of the plurality of the first connecting terminals 4*a* to 4*c* that is located in the center when the stacked state is formed is hardly deformed apparently by the pressing of the two connecting members 9 described below, so that it can be formed so as to be more rigid than the other first connecting terminals 4*a* and 4*c*. In order to form the first connecting terminal 4*b* to be more rigid than the other first connecting terminals 4*a* and 4*c*, for example, it is preferable that the first connecting terminal 4*b* is formed to have a thickness larger than the other first connecting terminals 4*a* and 4*c*.

A plurality of the insulation members 8*a* to 8*d* include a plurality of the first insulation members 8*a* to 8*c* housed in the first terminal housing 5 in alignment with each other and integrally fixed to each of the other surfaces (surfaces opposite to the surfaces to be bonded to the second connecting terminals 6*a* to 6*c*) of the first connecting terminals 4*a* to 4*c*, and the second insulation member 8*d* disposed so as to face the other surface (a surface opposite to the surface to be bonded to the first connecting terminal 4*c*) of the second connecting terminal 6*c* that locates at the outermost position when a plurality of the first connecting terminals 4*a* to 4*c* and a plurality of the second connecting terminal 6*a* to 6*c* are stacked.

Figure 5A:
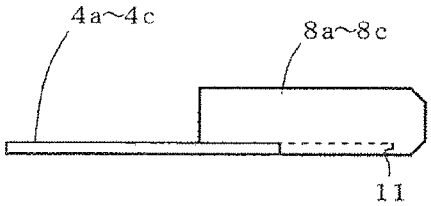
FIG. 5A is a side view schematically showing a first connecting terminal.
Figure 5B:
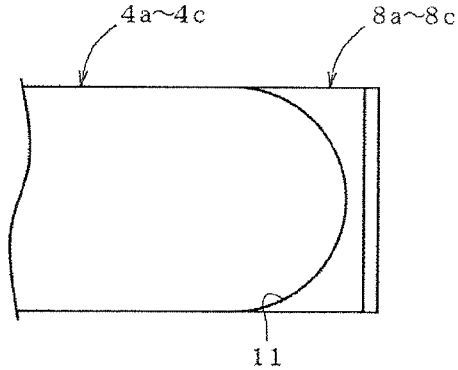
FIG. 5B is a bottom view schematically showing a first connecting terminal.

A plurality of the insulation members 8*a* to 8*d* are fixed in such a position that they project from the forward ends of the first connecting terminals 4*a* to 4*c*. Each of the insulation members 8*a* to 8*d* are chamfered at each of the corners located at the side into (from) which the second connecting terminals 6*a* to 6*c* are inserted (removed). In addition, as shown in FIGS. 5A and 5B, fitting grooves 11 are formed in the first insulation member 8*a* to 8*c*, so as to be fitted by the first connecting terminals 4*a* to 4*c* as objects to be fixed. The first connecting terminals 4*a* to 4*c* as objects to be fixed are fitted and integrally fixed to the fitting grooves 11. Due to this, difference in level between the first insulation member 8*a* to 8*c* and the first connecting terminals 4*a* to 4*c* are eliminated, and a plurality of the lower surfaces (surfaces shown on the lower side in the drawings) of the first insulation members 8*a* to 8*c* become in flush with the lower surfaces (surfaces shown on the lower side in the drawings) of the first connecting terminals 4*a* to 4*c*. Due to these compositions, insertion and removal properties of the second connecting terminals 6*a* to 6*c* to the first connecting terminal 4*a* to 4*c* when the first connector part 2 and the second connector part 3 are fitted to each other can be enhanced. Further, in FIG. 5A, the first insulation member 8*a* is shown by simplifying the structure thereof and the first insulation members 8*a* to 8*c* are shown in the same fashion.

Figure 6A:
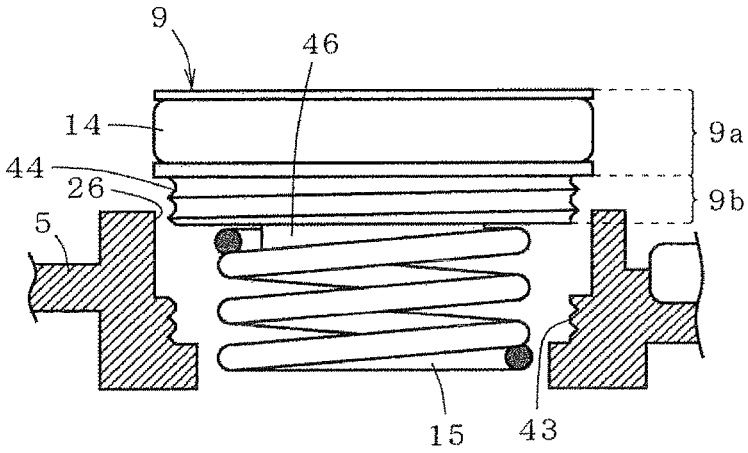
FIG. 6A is a side view schematically showing a connecting member.

As shown in FIG. 6A, the connecting member 9 is formed of metal such as SUS, iron, copper alloy, and includes a large diameter part 9*a* and a small diameter part 9*b* formed integrally with the large diameter part 9*a*.

In a periphery of the large diameter part 9*a*, a packing 14 for preventing water from entering into the first terminal housing 5 is installed.

In a peripheral surface of the small diameter part 9*b*, a male screw 44 to be screwed to a female screw 43 formed in an inner peripheral surface of a connecting member insertion hole 26 of the first terminal housing 5 is formed. Due to the composition, the connecting member 9 is formed so as to press the insulation member 8*a* or 8*d* adjacent thereto by being screwed to the first terminal housing 5. Also, one of the two connecting members 9 is formed to be a right-hand screw and another is formed to be an inversely threaded screw, and they are formed to be fastened simultaneously by a lever described later.

Figure 6B:
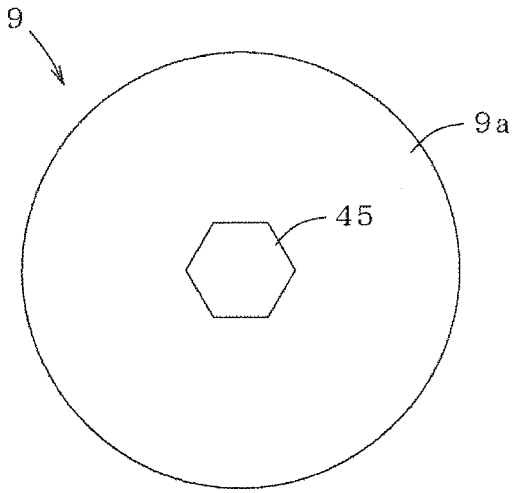
FIG. 6B is a top view schematically showing a connecting member.

Further, as shown in FIG. 6B, in the upper surface, an irregularly shaped hole (FIG. 6B shows as a hexagonal hole) 45 is formed, and a synchronizing member 47 is fitted to the deformed hole 45 and rotated, so that the fastening can be carried out.

The synchronizing members 47 include, for example, levers (for example, a connector position assurance (CPA) lever) for rotating about the two connecting members 9 as rotation axes, and the lever is rotated and the two connecting members 9 are screwed, so that the pressing by each of the two connecting members 9 is synchronized. As just described, the two connecting members 9 are formed so as to synchronously press due to the synchronizing member 47.

Figure 7:
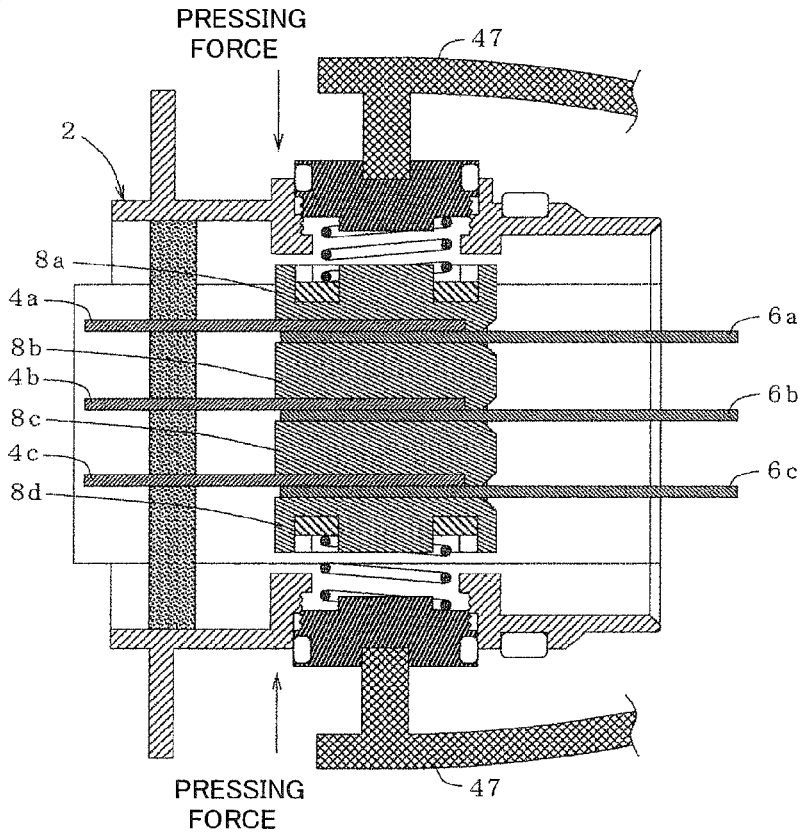
FIG. 7 is a cross-sectional view schematically showing a shape of a lever before the pressing by the connecting member.
Figure 8:
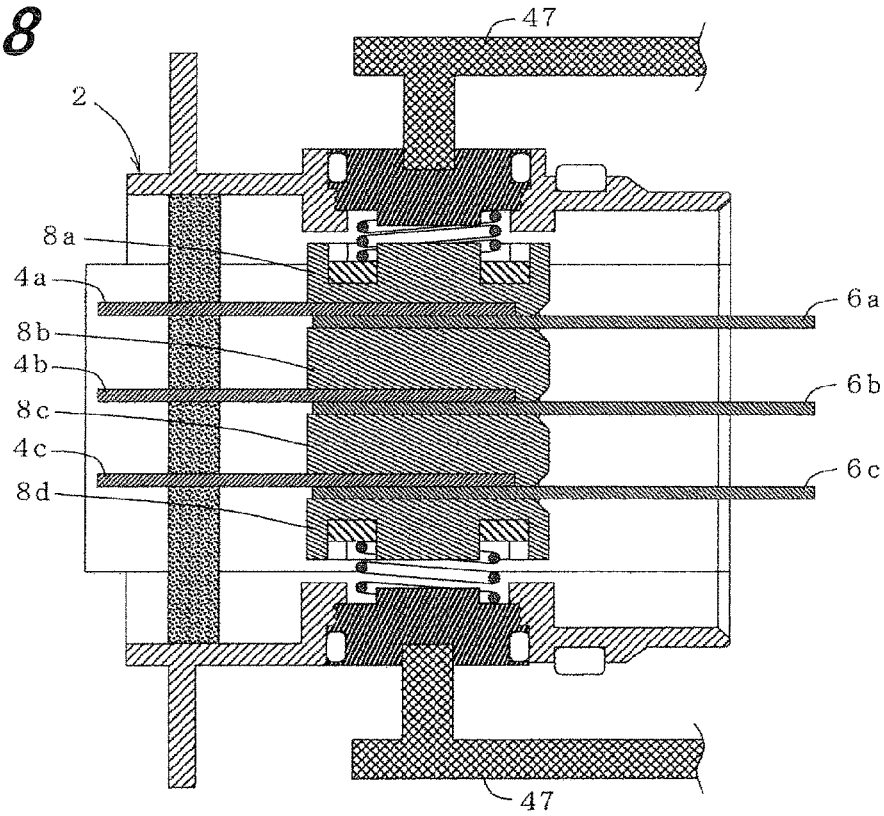
FIG. 8 is a cross-sectional view schematically showing a shape of a lever after the pressing by the connecting member.

As shown in the embodiment, in the case that the synchronizing member 47 is fixed to the connecting member 9, as shown in FIGS. 7 and 8, the synchronizing member 47 is changed in a shape before-and-after the pressing. In this case, it is preferable that the synchronizing member 47 is formed so as not to be deformed in the shape after the pressing.

Due to the composition, it can be realized that before the pressing of the connecting member 9, a force that presses the connecting member 9 to the first terminal housing 5 acts, and after the pressing of the connecting member 9, an outer force is not applied to the connecting member 9, so that before the pressing, the connecting member 9 can be prevented from being fallen off from the first terminal housing 5, and after the pressing, generation of stress that inhibits the pressing due to the connecting member 9 can be prevented. Further, in FIGS. 7 and 8, the second connector part 3 is not shown and only the second connecting terminals 6*a* to 6*c* are shown.

Once again, referring to FIG. 6, the connecting member 9 is formed so as to have a shape with two outer diameter dimensions of the large diameter part 9*a* to which the packing 14 is installed and the small diameter part 9*b* in which the male screw 44 is formed, and the connecting member insertion hole 26 is formed so as to have a shape that corresponds to the shape with two outer diameter dimensions. Due to the composition, when the connecting member 9 is fastened to the connecting member insertion hole 26, the male screw 44 is not formed in a part that faces the packing 14, so that an effective waterproof structure can be realized.

In addition, an elastic member 15 for applying a predetermined pressing force to the first insulation member 8*a* or the second insulation member 8*d* is formed between a lower surface of the small diameter part 9*b* (a surface that faces the first insulation member 8*a* or the second insulation member 8*d*) and an upper surface of the first insulation member 8*a* or a lower surface of the second insulation member 8*d* adjacent to the lower surface of the small diameter part 9*b*. The elastic member 15 is formed of, for example, a spring of metal such as SUS.

Further, in the embodiment, the elastic member 15 is positioned as a part of the connecting member 9. Consequently, an elastic member retention part 46 for engaging and retaining the elastic member 15 formed in the lower surface of the small diameter part 9*b*, and the elastic member 15 is retained by the elastic member retention part 46, so that it forms a part of the connecting member 9.

In an upper surface of the first insulation member 8*a* or a lower surface of the second insulation member 8*d* which a part of the elastic member 15 comes into contact with, a concave portion 16 covering (housing) the part of the elastic member 15 is formed, and in a bottom portion of the concave portion 16 (namely, a seat portion with which the lower portion of the elastic member 15 comes into contact), a receiving member 17 of metal such as SUS is installed, the receiving member 17 being used for receiving the elastic member 15 and preventing the first insulation member 8*a* or the second insulation member 8*d* formed of the nonconductive resin from being damaged.

The receiving member 17 prevents the damage of the first insulation member 8*a* or the second insulation member 8*d* by dispersing stress applied to the upper surface of the first insulation member 8*a* or the lower surface of the second insulation member 8*d* from the elastic member 15. Consequently, it is preferable that a contact area of the receiving member 17 and the first insulation member 8*a* or the second insulation member 8*d* is formed so as to be as large as possible. In the embodiment, in order to increase the contact area of the receiving member 17 and the first insulation member 8*a* or the second insulation member 8*d*, the receiving member 17 having a shape that it comes into contact over the entire bottom surface of the concave portion 16 is installed.

The connecting member 9 presses the first insulation member 8*a* or the second insulation member 8*d* adjacent thereto, and collectively fixes and electrically connects a plurality of the first connecting terminals 4*a* to 4*c* and a plurality of the second connecting terminals 6*a* to 6*c* at each contact.

Once again, referring to FIG. 4, the first terminal housing 5 is formed of a hollow tubular body 20 having a cross-section of nearly rectangular shape. An outer peripheral part in one end side (FIG. 4 shows as a right side) of the tubular body 20 fitted to the second terminal housing 7 is formed so as to have a taper shape, in view of the fitting capabilities to the second connector part 3. Also, in the outer peripheral part in one end side of the tubular body 20, a terminal housing waterproof structure 21 for sealing between the first connector part 2 and the second connector part 3 is formed. The terminal housing waterproof structure 21 includes a concave portion 22 formed in an outer peripheral part in an opening side of the tubular body 20 and a packing 23 such as an O-ring formed in the concave portion 22.

In another end side (FIG. 4 shows as a left side) of the tubular body 20, the resin compact 10 in which each of the first connecting terminals 4*a* to 4*c* is aligned and held is housed. In the outer peripheral part in another end side of the tubular body 20, a flange 24 for fixing the first connector part 2 to a case body such as a device, for example, a shield case of motor is formed. In a peripheral edge part 25 of the flange 24 for inserting a bolt into the mounting holes 24*a* (refer to FIGS. 1 and 2) and fixing to the case body such as a device, a packing or the like for sealing between the case body such as a device and the first connector part 2 can be installed. Further, the composition of the flange 24 is not base on the promise that the first connector part 2 is fixed to the case body such as a device, but the flange 24 can be installed in the second connector part 3 or it can be installed in both of the first connector part 2 and the second connector part 3. In addition, both of the first connector part 2 and the second connector part 3 may be free without being fixed to the case body such as a device.

In addition, the flange 24 is effective in enhancing radiation properties. Namely, due to forming the flange 24, the surface area of the first terminal housing 5 can be increased, and when heat generated in the first connector part 2 (for example, heat generated at each contact) is dissipated exteriorly via the first terminal housing 5, the radiation properties can be enhanced.

In the upper portion and the lower portion (FIG. 4 shows as the upper side and the lower side) of the tubular body 20, a connecting member insertion hole 26 into which the two connecting members 9 are inserted is respectively formed. The connecting member insertion hole 26 is formed so as to have a tubular shape and the lower end portion (FIG. 4 shows as a lower side) of the tubular shape is folded interiorly. A peripheral edge part of a lower surface of the small diameter part 9*b* of the connecting member 9 comes into contact with the folded part so that stroke of the connecting member 9 can be controlled.

It is preferable that the tubular body 20 is formed of metal such as aluminum having a high electric conductivity, a high heat conductivity and a light weight in view of shield performance, radiation properties and reduction in weight, but it can be formed of a resin or the like. In case that the first terminal housing 5 is formed of a nonconductive resin, the second insulation member 8*d* and the first terminal housing 5 can be integrally formed with the nonconductive resin. Further, in the embodiment, the tubular body 20 is formed of aluminum. As described above, the tubular body 20 is formed of aluminum so that an advantage that when the connecting member 9 is screwed to the connecting member insertion hole 26, it can be fastened more firmly in comparison with a case that the tubular body 20 is formed of an insulating resin can be obtained.

Figure 9:
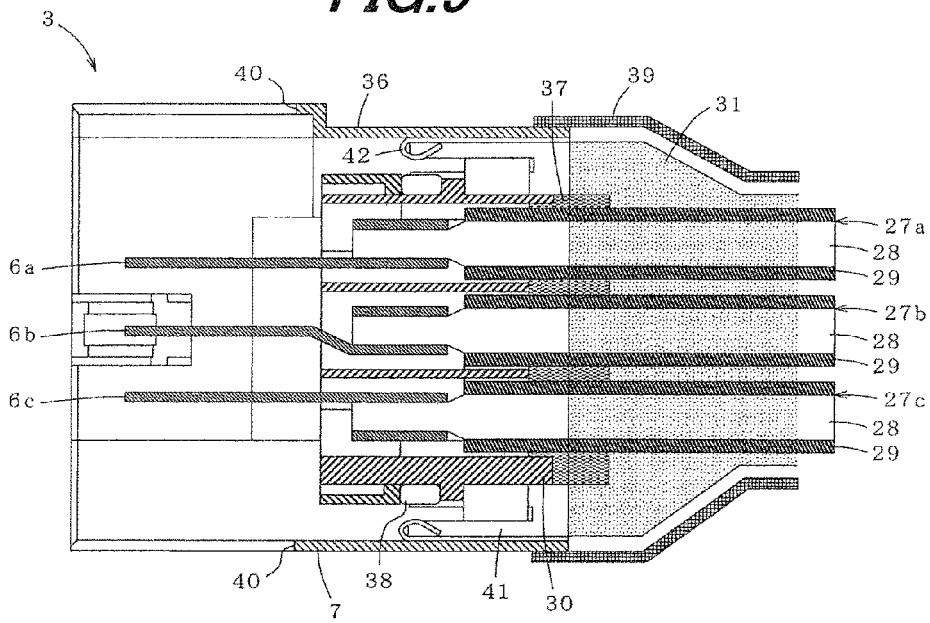
FIG. 9 is a cross-sectional view schematically showing the second connector part.

As shown in FIG. 9, the second connector part 3 includes a second terminal housing 7 in which a plurality of (three) second connecting terminals (female terminals) 6*a* to 6*c* are housed in alignment with each other. Further, here, a connector part having the female terminals is called as the second connector part 3. Namely, the second terminal housing 7 can be any of male (a male terminal housing) and female (a female terminal housing) as a terminal housing. Here, corresponding to the fact that the first terminal housing 5 is a male terminal housing, a case that the second terminal housing 7 is a female terminal housing is explained.

Cables 27*a* to 27*c* extending from an inverter side are connected to each of one end sides of the second connecting terminals 6*a* to 6*c*. Each of the cables 27*a* to 27*c* is electrically connected to each of the first connecting terminals 4*a* to 4*c* via the second connecting terminals 6*a* to 6*c*, so that electricity of voltage and/or current corresponding to each of the first connecting terminals 4*a* to 4*c* is transmitted. Each of the cables 27*a* to 27*c* includes a conducting body 28 and an insulating layer 29 formed on an outer periphery of the conducting body 28. In the embodiment, the conducting body 28 having a surface area of 20 square mm is used.

Each of the cables 27*a* to 27*c* is held by a cable holding member 30 having a multiple tubular shape, namely a shape that a plurality of tubes are connected to each other, so as to be located apart at certain intervals in alignment with each other. By the cable holding member 30, when the first connector part 2 and the second connector part 3 are fitted to each other, each of the second connecting terminals 6*a* to 6*c* is positioned and held so as to be located below each of the first connecting terminals 4*a* to 4*c* that faces each of the second connecting terminals 6*a* to 6*c* so as to form a pair with each other (namely, that is an object to be connected).

The cable holding member 30 is formed of a nonconductive resin or the like in order to insulate each of the second connecting terminals 6*a* to 6*c* from each other and prevent it from short-circuiting. By the cable holding member 30, even if each of the cables 27*a* to 27*c* connected to each of the second connecting terminals 6*a* to 6*c* is excellent in flexibility, each of the second connecting terminals 6*a* to 6*c* can be held at a predetermined position. Namely, in the embodiment, a cable excellent in flexibility can be used as the cables 27*a* to 27*c*, so that degree of freedom of wiring when the cables 27*a* to 27*c* are laid can be increased.

Further, the cable holding member 30 carries out the positioning of the second connecting terminals 6*a* to 6*c* so as to hold the second connecting terminals 6*a* to 6*c* at a predetermined position by holding the cables 27*a* to 27*c*, particularly by holding end portion sides of the cables 27*a* to 27*c* that are adjacent to second connecting terminals 6*a* to 6*c*, but the positioning of the second connecting terminals 6*a* to 6*c* can be also carried out by holding the cables 27*a* to 27*c* and simultaneously holding second connecting terminals 6*a* to 6*c* directly. In addition, a connecting terminal holding member that does not hold the cables 27*a* to 27*c*, but holds the second connecting terminals 6*a* to 6*c* directly can be also used instead of the cable holding member 30.

With regard to the cable holding member 30, in the case of carrying out the positioning by holding the cables 27*a* to 27*c* instead of holding the second connecting terminals 6*a* to 6*c* directly, namely in the case of the embodiment, the cables 27*a* to 27*c* is formed of an flexible material so that the forward end sides of the second connecting terminals 6*a* to 6*c* can be formed to have a bendability to the second terminal housing 7. Due to the above-mentioned composition, in the first connector part 2, the first connecting terminals 4*a* to 4*c* are deformed by the pressing of the connecting member 9 and even if positions of the parts into which the second connecting terminals 6*a* to 6*c* are inserted are somewhat changed, a flexible response can be ensured.

In addition, a braided shield 31 for enhancing a shield performance is wrapped around the parts of the cables 27*a* to 27*c* that are pulled out of the second terminal housing 7. The braided shield 31 comes into contact with a tubular shield body 41 described below and is electrically connected (has identical potentials (GND)) to the first terminal housing 5 via the tubular shield body 41. Further, the braided shield 31 is not shown in FIGS. 1 and 2 for the purpose of simplification.

Figure 10A:
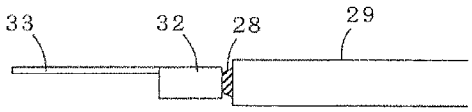
FIG. 10A is a side view schematically showing a second connecting terminal.
Figure 10B:
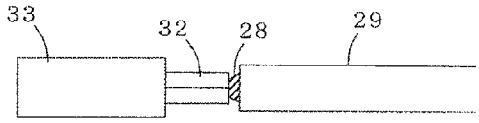
FIG. 10B is a bottom view schematically showing a second connecting terminal.
Figure 11A:
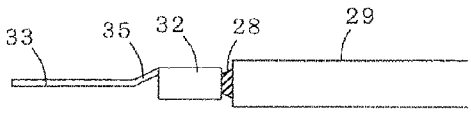
FIG. 11A is a side view schematically showing a second connecting terminal.
Figure 11B:
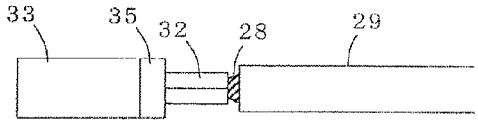
FIG. 11B is a bottom view schematically showing a second connecting terminal.

As shown in FIGS. 10 and 11, each of the second connecting terminals 6*a* to 6*c* includes a swaging part 32 for swaging the conductive body 28 exposed from the forward end parts of the cables 27*a* to 27*c* and a plate-like contact 33 integrally formed with the swaging part 32. The forward end part of the plate-like contact 33 can be formed to have a taper shape for the purpose of enhancing insertion properties.

In the embodiment, in order to reduce the size of the connector 1, each of the cables 27*a* to 27*c* is formed so as to be aligned and held as tightly as possible. Consequently, as shown in FIG. 11, a body part 35 of the second connecting terminal 6*b* to be connected to the cable 27*b* that is arranged in the center at the alignment is bent, so that the second connecting terminals 6*a* to 6*c* can be arranged so as to be located apart at the same intervals.

It is preferable that each of the second connecting terminals 6*a* to 6*c* is formed of metal such as silver, copper, aluminum having a high electric conductivity for the purpose of reducing transmission loss at the connector 1 or the like. In addition, each of the second connecting terminals 6*a* to 6*c* has some flexibility.

Once again, referring to FIG. 9, the second terminal housing 7 is formed of a hollow tubular body 36 having a cross-section of nearly rectangular shape. Since the first terminal housing 5 is fitted in the second terminal housing 7, an inner peripheral part in one end side (FIG. 9 shows as a left side) of the tubular body 36 fitted to the first terminal housing 5 is formed so as to have a taper shape, in view of the fitting capabilities to the first terminal housing 5.

Further, adversely, a composition that the second terminal housing 7 is fitted in the first terminal housing 5 can be also adopted. In this case, it is preferable that an inner peripheral part in one end side of the tubular body 20 constituting the first terminal housing 5 is formed so as to have a taper shape, an outer peripheral part in one end side of the tubular body 36 constituting the second terminal housing 7 is formed so as to have a taper shape, and the terminal housing waterproof structure 21 is formed on an outer peripheral part in one end side of the tubular body 36.

The cable holding member 30 for aligning and holding each of the cables 27*a* to 27*c* is housed in another end side (FIG. 9 shows as a right side) of the tubular body 36. A packingless air-tight part 37 is formed in a cable insertion side of the cable holding member 30 so as to prevent water from entering into the second terminal housing 7 through the cables 27*a* to 27*c*. A packing 38 that comes into contact with the inner peripheral surface of the first terminal housing 5 is formed on the outer peripheral part of the cable holding member 30. Namely, the connector 1 is formed so as to have a double waterproof structure that includes the packing 23 of the terminal housing waterproof structure 21 and the packing 38 formed on the outer peripheral part of the cable holding member 30.

In addition to the above, the outer periphery of another side of the tubular body 36 out of which the cables 27*a* to 27*c* are pulled is covered with a rubber boot 39 so as to prevent water from entering into the tubular body 36. Further, the rubber boot 39 is not shown in FIGS. 1 and 2 for the purpose of simplification.

In addition, an avoidance groove 40 for avoiding the synchronizing member 47 formed in the first terminal housing 2 when the second connector part 3 and the first connector part 2 are fitted to each other is formed in the upper portion and the lower portion (FIG. 9 shows as an upper side and a lower side) of the tubular body 36.

It is preferable that the tubular body 36 is formed of metal such as aluminum having a high electric conductivity, a high heat conductivity and a light weight in view of shield performance, radiation properties and reduction in weight of the connector 1, but it can be formed of a resin or the like. In the embodiment, the tubular body 36 is formed of a nonconductive resin, consequently, a tubular shield body 41 formed of aluminum is installed on an inner peripheral surface of another end side of the tubular body 36.

The tubular shield body 41 has a contact part 42 for coming into contact with an outer periphery of the first terminal housing 5 formed of aluminum when the first connector part 2 and the second connector part 3 are fitted to each other, and is thermally and electrically connected to the first terminal housing 5 via the contact part 42. Due to this, shield performance and radiation properties can be enhanced. In particular, with regard to radiation properties, remarkable improvement is expected due to transferring heat aggressively to a side of the first terminal housing 5 excellent in radiation properties.

Next, the connection between the first connecting terminals 4*a* to 4*c* and the second connecting terminals 6*a* to 6*c* by using the connector 1 according to the embodiment will be explained.

When the first connector part 2 and the second connector part 3 are fitted to each other, each of the second connecting terminals 6*a* to 6*c* is inserted between each of the first connecting terminals 4*a* to 4*c* with which each of the second connecting terminals 6*a* to 6*c* forms a pair and each of the first insulation members 8*a* to 8*c*. And, due to the insertion, a stacked condition is formed, that each one surface of a plurality of the first connecting terminals 4*a* to 4*c* and each one surface of a plurality of the second connecting terminals 6*a* to 6*c* face each other so that they form a pair with each other, and the first connecting terminals 4*a* to 4*c*, the second connecting terminals 6*a* to 6*c* and the insulation members 8*a* to 8*d* are alternately arranged.

In this case, in the first connector part 2, each of the insulation members 8*a* to 8*c* is fixed to the forward end side of the first connecting terminals 4*a* to 4*c* that are held in alignment with each other so as to be located apart at certain intervals, so that intervals among the first insulation members 8*a* to 8*c* can be retained without separately installing a retention jig for retaining intervals among the first insulation members 8*a* to 8*c*. Due to this, each of the second connecting terminals 6*a* to 6*c* can be easily inserted between each of the first connecting terminals 4*a* to 4*c* with which each of the second connecting terminals 6*a* to 6*c* forms a pair and the insulation members 8*a* to 8*d*. Namely, insertion and removal properties of the second connecting terminals 6*a* to 6*c* are not be reduced. In addition, it is not necessary to install the retention jig for retaining intervals among the first insulation members 8*a* to 8*c*, so that it is extremely effective in view of being capable of realizing a further downsizing in comparison with a conventional technique.

In addition, the contact of the first connecting terminal 4*a* (or 4*b*) and the second connecting terminal 6*a* (or 6*b*) is sandwiched between the first insulation member 8*a* (or 8*b*) fixed to the first connecting terminal 4*a* (or 4*b*) constituting the contact and the first insulation member 8*b* (or 8*c*) fixed to the first connecting terminal 4*b* (or 4*c*) constituting the other contact. Similarly, the contact of the first connecting terminal 4*c* and the second connecting terminal 6*c* is sandwiched between the first insulation member 8*c* fixed to the first connecting terminal 4*c* constituting the contact and the second insulation member 8*d* fixed to the inner surface of the first terminal housing 5.

After that, as shown in FIG. 3, when the synchronizing member 47 is rotated so that the two connecting members 9 are synchronously rotated and the male screw 44 of the connecting member 9 is screwed and fastened to the female screw 43 of the first terminal housing 5, each of the connecting members 9 is pushed while rotating and simultaneously the first insulation member 8*a* and the second insulation member 8*d* are pressed toward the center side of the stacked state by the elastic member 15, each of contacts are pressed so as to be sandwiched by any two of the insulation members 8*a* to 8*d*, and each of contacts comes into contact with each other in an insulated condition. At this time, each of the first connecting terminals 4*a* to 4*c* and each of the second connecting terminals 6*a* to 6*c* somewhat bend by the pressing of the insulation members 8*a* to 8*d* and come into contact with each other in a wide area. Due to this, a connector particularly effective for vehicles in which vibration is easily generated can be realized.

As just described, the first connecting terminals 4*a* to 4*c* and the second connecting terminals 6*a* to 6*c* somewhat bend by the fastening of the connecting members 9, but due to temporal change or repeat of fastening and releasing of the connecting members 9, the first connecting terminals 4*a* to 4*c* and the second connecting terminals 6*a* to 6*c* deform so as to be inclined in a direction of the fastening of the connecting members 9.

In accordance with the deformation of the first connecting terminals 4*a* to 4*c*, the first insulation members 8*a* to 8*c* are also inclined in a direction of the fastening of the connecting members 9, when the deformation of the first connecting terminals 4*a* to 4*c* is increased, the first insulation members 8*a* to 8*c* are sequentially pressed by the second insulation member 8*d* at the time when the connector 1 is not fitted yet, and the insulation members 8*a* to 8*d* are arranged so as to be stacked in a state of coming into contact with each other.

As just described, in the case that the insulation members 8*a* to 8*d* are arranged so as to be stacked, when the first connecting terminals 4*a* to 4*c* and the second connecting terminals 6*a* to 6*c* are connected to each other by reusing the connector 1, forward end parts of the second connecting terminals 6*a* to 6*c* result in butting against any one of the insulation members 8*a* to 8*d* at the time of the fitting, so that the insertion of the second connecting terminals 6*a* to 6*c* becomes extremely difficult.

In the connector 1 according to the embodiment, the stacked state of the first connecting terminals 4*a* to 4*c*, the second connecting terminals 6*a* to 6*c* and the insulation members 8*a* to 8*d* is synchronously pressed so as to be sandwiched from two directions by the two connecting members 9, so that displacements of the first connecting terminals 4*a* to 4*c* and the second connecting terminals 6*a* to 6*c* when pressed by the connecting members 9 can be reduced by half in comparison with the conventional structure in which only one connecting member 9 is installed and the deformation can be prevented.

Consequently, forward end parts of the second connecting terminals 6*a* to 6*c* result in butting against any of the insulation members 8*a* to 8*d* at the time of the fitting, so that a state that the insertion of the second connecting terminals 6*a* to 6*c* becomes extremely difficult is hardly brought. Namely, the connector 1 according to the embodiment has a high durability even after repeated uses.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

For example, in the embodiment, a power line of three-phase alternating current is assumed, but according to the technical idea of the invention, a composition that a plurality of power lines different from each other in applications such as a power line of three-phase alternating current used for a connection between a motor and an inverter, a power line of two-phase direct current used for an air conditioner in a connector for vehicles are collectively connected to each other can be also adopted. Due to this composition, power lines for a plurality of applications can be collectively connected to each other by one connector, so that it is not necessary to prepare different connectors for the respective applications and it can contribute to space saving and cost reduction.

In addition, in the embodiment, each of the first connecting terminals 4*a* to 4*c* and each of the second connecting terminals 6*a* to 6*c* come into contact with each other so as to be in surface contact with each other, but a composition that convex portions are formed in each surface of the first connecting terminals 4*a* to 4*c* that is a surface located at a side of the contacts and comes to contact into each of the second connecting terminals 6*a* to 6*c*, and the plate-like contacts 33 of the second connecting terminals 6*a* to 6 are fitted to the convex portions can be also adopted. Due to this composition, a bonding force between each of the first connecting terminals 4*a* to 4*c* and each of the second connecting terminals 6*a* to 6*c* can be further stabilized. Namely, this composition is particularly effective in vibration perpendicular to the connecting member 9.

In addition, a composition that terminal surfaces of each of the first connecting terminals 4*a* to 4*c* and each of the second connecting terminals 6*a* to 6*c* are roughened by a knurling process or the like so as to increase a friction force and allow the terminals to hardly move with respect to each other, so that the fixing at each contact can be strengthened can be also adopted.

In addition, in the embodiment, a composition that each of the first connecting terminals 4*a* to 4*c* and each of the second connecting terminals 6*a* to 6*c* are brought into contact with each other in a linear shape is adopted, when viewed from a side of the large diameter part 9*a* of the connecting member 9, but the first terminal housing 5 and the second terminal housing 7 can be formed so as to have a composition that each of the first connecting terminals 4*a* to 4*c* of the first connector part 2 intersects at a right angle and comes into contact with each of the second connecting terminals 6*a* to 6*c* of the second connector part 3, when viewed from a side of the large diameter part 9*a* of the connecting member 9. Namely, the first connector part 2 and the second connector part 3 can be fitted to each other in the L-shape. Similarly, a composition that the second terminal housing 7 and the second connecting terminals 6*a* to 6*c* are located at an oblique position to the first terminal housing 5 and the first connecting terminals 4*a* to 4*c* can be also adopted. The basic teaching of the invention is applied as described above, so that an insertion and removal direction of the second connector part 3 into (from) the first connector part 2 can be diversified. In short, a pull-out direction of the cable from the connector can be adjusted in a desired direction, so that it can contribute to space-saving.

In addition, in the embodiment, a case that nothing is connected to one end sides of the first connecting terminals 4*a* to 4*c*, different from the case of the second connecting terminals 6*a* to 6*c* is explained, but not limited to this composition. Namely, the connector according to the invention can be used in a case that the cables are connected to each other.

In addition, in the embodiment, a cable excellent in flexibility is used as the cables 27*a* to 27*c*, but a cable that is rigid can be also used.

In addition, in the embodiment, with regard to a disposition of the connector in use situation, the connecting member 9 can be disposed to any of nearly horizontal situation and nearly perpendicular situation. Namely, the disposition in use situation is not included in use conditions to be required for the connector according to the invention.

In addition, in the embodiment, the first insulation member 8*a* or the second insulation member 8*d* adjacent to the connecting member 9 is pressed by the connecting member 9 via the elastic member 15 constituting a part of the connecting member 9, but a composition that the first insulation member 8*a* or the second insulation member 8*d* adjacent to the connecting member 9 is directly pressed by the connecting member 9 not through the elastic member 15 can be also adopted.

In addition, in the embodiment, as the synchronizing member 47, a lever having a composition that the shape is changed before-and-after the pressing is used, but for example, a composition that a shaft part having an irregularly shaped cross section is installed in an upper surface of the large diameter part 9*a* of the connecting member 9 so as to extend, and the lever is engaged with the shaft part having an irregularly shaped cross section so as to be movable in an axis direction can be also adopted. In this case, the synchronizing member 47 does not change in the shape before-and-after the pressing.

What is claimed is:

1. A connection structure, comprising:

a first terminal housing with a plurality of first connecting terminals aligned and accommodated therein;

a second terminal housing with a plurality of second connecting terminals aligned and accommodated therein;

a plurality of insulation members aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of insulation members;

two connecting members disposed to sandwich a stack structure of the plurality of the first connecting terminals, the plurality of the second connecting terminals and the plurality of the insulation members at a top end and a bottom end of the stack structure, the two connecting members each pressing an adjacent insulation member of the plurality of insulation members, to thereby collectively fix the plurality of first connecting terminals and the plurality of second connecting terminals at contacts for electrical connections therebetween; and a synchronizing member to allow the two connecting members to press synchronously the adjacent insulation member.

2. The connection structure according to claim 1, wherein the synchronizing member comprises a lever to rotate around the two connecting members as a rotation shaft, the two connecting members are each screwed into the first terminal housing or the second terminal housing to press the adjacent insulation member, and when the lever rotates to screw the two connecting members thereinto, the two connecting members is allowed to press synchronously the adjacent insulation member.

3. The connection structure according to claim 2, wherein the connecting member comprises a large diameter part and a small diameter part integrated with the large diameter part and screwed into the first terminal housing or the second terminal housing, and the large diameter part comprises a packing for sealing between the connecting member and the first terminal housing or the second terminal housing.

4. The connection structure according to claim 2, wherein the first terminal housing or the second terminal housing into which the connecting members are not screwed comprises an avoidance groove for avoiding the lever.

5. The connection structure according to claim 1, wherein one of the plurality of first connecting terminals that is centrally located when the stacked state is exhibited is more rigid than an other of the plurality of first connecting terminals.

* * * * *